US012565365B2

(12) United States Patent
Usowicz et al.

(10) Patent No.: US 12,565,365 B2
(45) Date of Patent: Mar. 3, 2026

(54) SOLVENT TUBE MANAGEMENT

(71) Applicant: Waters Technologies Corporation, Milford, MA (US)

(72) Inventors: James E. Usowicz, Webster, MA (US); Stanislaw Koziol, Wrentham, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 18/613,271

(22) Filed: Mar. 22, 2024

(65) Prior Publication Data

US 2024/0317470 A1 Sep. 26, 2024

Related U.S. Application Data

(60) Provisional application No. 63/454,538, filed on Mar. 24, 2023.

(51) Int. Cl.

| | |
|---|---|
| ***B65D 51/24*** | (2006.01) |
| ***B65D 41/04*** | (2006.01) |
| *B01L 3/00* | (2006.01) |

(52) U.S. Cl.

CPC ..... *B65D 51/245* (2013.01); *B65D 41/04* (2013.01)

(58) Field of Classification Search

CPC ..... A01G 17/04; A01G 20/20; A01G 23/091; A01G 23/095; A01G 25/00; A01G 25/02;

(Continued)

(56) References Cited

U.S. PATENT DOCUMENTS 4,080,989 A * 3/1978 Chapelsky ..... B65D 47/06 137/637.1
4,919,309 A 4/1990 Arona-Delonghi (Continued)

FOREIGN PATENT DOCUMENTS

DE 9212525 U1 * 1/1993 ..... B67D 7/0238
GB 2090129 A 7/1982

(Continued)

OTHER PUBLICATIONS

"Less Stress More Peace of MindL Agilent InfinityLab State Safe caps and accessories" brochure, Agilent Technologies, Sep. 17, 2021.

(Continued)

*Primary Examiner* — Anthony D Stashick
*Assistant Examiner* — Marcos Javier Rodriguez Molina
(74) *Attorney, Agent, or Firm* — Schmeiser, Olsen & Watts LLP; William G. Guerin, Esq.

(57) ABSTRACT

A bottle cap includes a lower cap body that is threaded for attachment about an opening in a solvent bottle and an upper cap body attached to the lower cap body. A liner disposed inside the lower cap body includes at least one opening to pass a solvent tube while limiting evaporation of the solvent in the bottle. Features in the upper cap body permit identification flags to be attached. Each flag has an opening to pass a corresponding tube and includes one or more characters or symbols, color-coding and/or shape-coding to identify the corresponding solvent and/or a system inlet to which the tube is connected at its other end. The upper and lower cap bodies are independently rotatable about a cap axis and allow the bottle cap to be removed from or attached to the bottle without the need to remove any tubes passing through the bottle cap.

12 Claims, 7 Drawing Sheets

(58) Field of Classification Search
CPC .... A01G 25/023; A01G 25/026; A01G 25/06; A01G 25/09; A01G 25/092; A01G 25/097; A01G 25/14; A01G 25/16; A01G 25/165; A01G 25/167; A01G 27/001; A01G 27/003; A01G 27/005; A01G 27/02; A01G 3/08; A01G 3/085; A01G 3/086; A01G 3/088; A01G 31/00; A01G 31/02; A01G 31/06; A01G 33/00; A01G 7/045; A01G 7/06; A01G 9/022; A01G 9/023; A01G 9/024; A01G 9/025; A01G 9/045; A01G 9/088; A01G 9/12; A01G 9/1423; A01G 9/143; A01G 9/225; A01G 9/24; A01G 9/247; B01L 1/02; B01L 1/04; B01L 13/02; B01L 2200/02; B01L 2200/021; B01L 2200/022; B01L 2200/025; B01L 2200/026; B01L 2200/027; B01L 2200/028; B01L 2200/04; B01L 2200/0605; B01L 2200/0621; B01L 2200/0631; B01L 2200/0636; B01L 2200/0647; B01L 2200/0652; B01L 2200/0668; B01L 2200/0673; B01L 2200/0684; B01L 2200/0689; B01L 2200/0694; B01L 2200/087; B01L 2200/10; B01L 2200/12; B01L 2200/141; B01L 2200/142; B01L 2200/143; B01L 2200/146; B01L 2200/147; B01L 2200/148; B01L 2200/16; B01L 2200/18; B01L 2300/02; B01L 2300/021; B01L 2300/022; B01L 2300/023; B01L 2300/025; B01L 2300/027; B01L 2300/028; B01L 2300/041; B01L 2300/042; B01L 2300/043; B01L 2300/044; B01L 2300/045; B01L 2300/047; B01L 2300/048; B01L 2300/049; B01L 2300/06; B01L 2300/0609; B01L 2300/0627; B01L 2300/0636; B01L 2300/0645; B01L 2300/0654; B01L 2300/0663; B01L 2300/0672; B01L 2300/0681; B01L 2300/069; B01L 2300/0803; B01L 2300/0809; B01L 2300/0816; B01L 2300/0819; B01L 2300/0822; B01L 2300/0825; B01L 2300/0829; B01L 2300/0832; B01L 2300/0838; B01L 2300/0851; B01L 2300/0858; B01L 2300/0861; B01L 2300/0864; B01L 2300/0867; B01L 2300/087; B01L 2300/0874; B01L 2300/0877; B01L 2300/0883; B01L 2300/0887; B01L 2300/0893; B01L 2300/10; B01L 2300/12; B01L 2300/123; B01L 2300/14; B01L 2300/16; B01L 2300/161; B01L 2300/163; B01L 2300/165; B01L 2300/168; B01L 2300/18; B01L 2300/1805; B01L 2300/1822; B01L 2300/1827; B01L 2300/1844; B01L 2300/1894; B01L 2400/04; B01L 2400/0406; B01L 2400/0409; B01L 2400/0415; B01L 2400/0421; B01L 2400/0424; B01L 2400/0427; B01L 2400/043; B01L 2400/0433; B01L 2400/0436; B01L 2400/0439; B01L 2400/0442; B01L 2400/0457; B01L 2400/0478; B01L 2400/0481; B01L 2400/0487; B01L 2400/049; B01L 2400/0496; B01L 2400/06; B01L 2400/0605; B01L 2400/0611; B01L 2400/0616; B01L 2400/0622; B01L 2400/0633; B01L 2400/0638; B01L 2400/0644; B01L 2400/065; B01L 2400/0655; B01L 2400/0666; B01L 2400/0677; B01L 2400/0683; B01L 2400/0688; B01L 2400/082; B01L 2400/086; B01L 3/00; B01L 3/02; B01L 3/0203; B01L 3/0206; B01L 3/021; B01L 3/0213; B01L 3/0217; B01L 3/0224; B01L 3/0227; B01L 3/0234; B01L 3/0237; B01L 3/0244; B01L 3/0262; B01L 3/0268; B01L 3/0272; B01L 3/0275; B01L 3/0289; B01L 3/0293; B01L 3/0296; B01L 3/08; B01L 3/502; B01L 3/5021; B01L 3/50215; B01L 3/5023; B01L 3/5025; B01L 3/50255; B01L 3/5027; B01L 3/502707; B01L 3/502715; B01L 3/502723; B01L 3/50273; B01L 3/502738; B01L 3/502746; B01L 3/502753; B01L 3/502761; B01L 3/502769; B01L 3/502776; B01L 3/502784; B01L 3/502792; B01L 3/5029; B01L 3/505; B01L 3/508; B01L 3/5082; B01L 3/50825; B01L 3/5085; B01L 3/50851; B01L 3/50853; B01L 3/50857; B01L 3/52; B01L 3/523; B01L 3/527; B01L 3/54; B01L 3/545; B01L 3/5453; B01L 3/5457; B01L 3/56; B01L 3/561; B01L 3/563; B01L 3/5635; B01L 3/565; B01L 3/567; B01L 7/00; B01L 7/52; B01L 7/525; B01L 7/5255; B01L 7/54; B01L 9/00; B01L 9/02; B01L 9/06; B01L 9/52; B01L 9/527; B01L 99/00; B65D 1/00; B65D 1/02; B65D 1/0207; B65D 1/023; B65D 1/0246; B65D 1/04; B65D 1/06; B65D 1/14; B65D 1/323; B65D 1/326; B65D 1/46; B65D 11/04; B65D 17/28; B65D 17/4012; B65D 17/4014; B65D 17/06; B65D 19/18; B65D 19/38; B65D 21/0209; B65D 21/0212; B65D 21/0228; B65D 21/023; B65D 21/0231; B65D 21/066; B65D 21/083; B65D 21/02; B65D 2203/04; B65D 2203/06; B65D 2205/00; B65D 2205/02; B65D 2215/00; B65D 2221/00; B65D 2231/005; B65D 2231/007; B65D 2251/0003; B65D 2251/0012; B65D 2251/0028; B65D 2251/0056; B65D 2251/0075; B65D 2251/0084; B65D 2251/0093; B65D 2251/02; B65D 2251/023; B65D 2251/1016; B65D 2251/1058; B65D 2275/02; B65D 23/00; B65D 23/04; B65D 23/08; B65D 23/0878; B65D 23/0885; B65D 23/106; B65D 23/12; B65D 2313/04; B65D 2313/06; B65D 2401/55; B65D 25/00; B65D 25/10; B65D 25/101; B65D 25/18; B65D 25/20; B65D 25/2873; B65D 25/2885; B65D 25/40; B65D 25/42; B65D 25/52; B65D 25/54; B65D 25/0045; B65D 2501/0063; B65D 2501/0022; B65D 2517/0041;

B65D 2517/0049; B65D 2517/0056; B65D 2517/0098; B65D 2517/5091; B65D 2517/00024; B65D 2519/00034; B65D 2519/00069; B65D 2519/00129; B65D 2519/00174; B65D 2519/00208; B65D 2519/00273; B65D 2519/00278; B65D 2519/00293; B65D 2519/00318; B65D 2519/00338; B65D 2519/00343; B65D 2519/00432; B65D 2519/00532; B65D 2519/00646; B65D 2519/00711; B65D 2519/0081; B65D 2519/009; B65D 2525/282; B65D 2525/00092; B65D 2543/00305; B65D 2543/00537; B65D 2547/063; B65D 2563/108; B65D 2565/385; B65D 2575/586; B65D 2577/2025; B65D 2583/0481; B65D 2585/56; B65D 2590/0066; B65D 2590/0083; B65D 2590/0091; B65D 2590/046; B65D 3/04; B65D 33/00; B65D 33/004; B65D 33/02; B65D 33/04; B65D 33/14; B65D 33/16; B65D 33/165; B65D 33/1691; B65D 33/20; B65D 33/22; B65D 33/24; B65D 33/25; B65D 33/2508; B65D 33/30; B65D 35/08; B65D 35/10; B65D 35/14; B65D 35/22; B65D 35/242; B65D 35/28; B65D 35/36; B65D 35/38; B65D 35/44; B65D 35/46; B65D 37/00; B65D 39/00; B65D 39/0005; B65D 39/0011; B65D 39/0029; B65D 39/0035; B65D 39/04; B65D 39/084; B65D 39/088; B65D 39/16; B65D 41/00; B65D 41/005; B65D 41/02; B65D 41/04; B65D 41/0414; B65D 41/0428; B65D 41/0442; B65D 41/0485; B65D 41/06; B65D 41/08; B65D 41/12; B65D 41/20; B65D 41/22; B65D 41/26; B65D 41/28; B65D 41/34; B65D 41/3409; B65D 41/62; B65D 43/02; B65D 43/0204; B65D 43/0222; B65D 43/0231; B65D 43/16; B65D 43/161; B65D 43/162; B65D 43/163; B65D 43/168; B65D 43/18; B65D 43/22; B65D 43/24; B65D 43/26; B65D 45/06; B65D 45/32; B65D 45/325; B65D 47/00; B65D 47/04; B65D 47/043; B65D 47/06; B65D 47/061; B65D 47/063; B65D 47/065; B65D 47/066; B65D 47/08; B65D 47/0804; B65D 47/0814; B65D 47/0828; B65D 47/0842; B65D 47/0857; B65D 47/0876; B65D 47/088; B65D 47/0885; B65D 47/10; B65D 47/12; B65D 47/121; B65D 47/122; B65D 47/123; B65D 47/14; B65D 47/141; B65D 47/147; B65D 47/18; B65D 47/20; B65D 47/2012; B65D 47/2018; B65D 47/2025; B65D 47/2031; B65D 47/2037; B65D 47/2043; B65D 47/2062; B65D 47/2068; B65D 47/24; B65D 47/241; B65D 47/242; B65D 47/243; B65D 47/247; B65D 47/248; B65D 47/26; B65D 47/263; B65D 47/265; B65D 47/28; B65D 47/283; B65D 47/305; B65D 47/32; B65D 47/36; B65D 47/42; B65D 49/00; B65D 49/02; B65D 49/04; B65D 49/06; B65D 5/0236; B65D 5/065; B65D 5/40; B65D 5/46008; B65D 5/5028; B65D 5/72; B65D 5/74; B65D 5/746; B65D 5/748; B65D 50/00; B65D 50/067; B65D 51/00; B65D 51/002; B65D 51/007; B65D 51/16; B65D 51/1611; B65D 51/1616; B65D 51/1644; B65D 51/165; B65D 51/1661; B65D 51/1672; B65D 51/1683; B65D 51/1688; B65D 51/18; B65D 51/185; B65D 51/20; B65D 51/22; B65D 51/221; B65D 51/224; B65D 51/226; B65D 51/24; B65D 51/242; B65D 51/243; B65D 51/245; B65D 51/246; B65D 51/248; B65D 51/28; B65D 51/2821; B65D 51/2828; B65D 53/00; B65D 53/02; B65D 53/04; B65D 53/08; B65D 55/02; B65D 55/022; B65D 55/024; B65D 55/026; B65D 55/06; B65D 55/066; B65D 55/0854; B65D 55/14; B65D 55/16; B65D 59/06; B65D 63/02; B65D 63/04; B65D 63/06; B65D 63/10; B65D 63/1009; B65D 63/1027; B65D 63/1063; B65D 63/12; B65D 63/18; B65D 65/02; B65D 65/20; B65D 65/38; B65D 65/40; B65D 65/42; B65D 65/46; B65D 65/463; B65D 65/466; B65D 69/00; B65D 7/04; B65D 71/00; B65D 71/066; B65D 71/08; B65D 71/50; B65D 71/502; B65D 73/0014; B65D 73/0064; B65D 73/0071; B65D 75/002; B65D 75/004; B65D 75/008; B65D 75/20; B65D 75/26; B65D 75/30; B65D 75/366; B65D 75/42; B65D 75/48; B65D 75/54; B65D 75/566; B65D 75/58; B65D 75/5805; B65D 75/5811

USPC .. 206/5, 6, 7, 210, 216, 219, 221, 222, 223, 206/225, 228, 229, 231, 232, 268, 278, 206/286, 294, 297, 3, 305, 315.11, 315.2, 206/315.3, 315.5, 315.6, 315.7, 320, 335, 206/338, 345, 349, 363, 364, 365, 366, 206/370, 372, 373, 382, 383, 386, 390, 206/391, 394, 395, 397, 408, 409, 413, 206/423, 438, 440, 45.2, 45.24, 457, 206/459.1, 459.5, 460, 462, 472, 484, 206/488, 49, 495, 497, 509, 514, 522, 206/524.1, 524.3, 524.5, 524.6, 524.8, 206/525, 526, 530, 562, 564, 568, 570, 206/571, 572, 576, 577, 581, 591, 600, 206/63.3, 702, 717, 803, 806, 813, 819, 206/820; 215/12.2, 230, 246, 247, 249, 215/251, 270, 280, 296, 306, 309, 341, 215/344, 355, 358, 365, 45, 47, 6, 900, 215/902, DIG. 3, 12.1, 2, 201, 228, 232, 215/253, 254, 307, 382, 384, 390, 395, 215/901; 220/1.5, 200, 202, 203.01, 220/203.06, 203.17, 203.23, 203.26, 220/203.28, 211, 212, 212.5, 219, 228, 220/23.2, 23.4, 23.83, 23.86, 234, 241, 220/242, 278, 288, 293, 295, 3.2, 3.3, 220/3.4, 3.5, 3.7, 3.8, 3.9, 3.94, 302, 303, 220/304, 324, 345.1, 361, 367.1, 375, 220/376, 377, 378, 4.01, 4.02, 4.03, 4.05, 220/4.12, 4.14, 4.16, 4.23, 4.26, 4.28, 220/4.32, 480, 483, 484, 495.01, 500, 220/501, 520, 521, 527, 531, 553, 560, 220/560.01, 560.03, 560.04, 560.05,

220/560.1, 560.12, 562, 563, 565, 567, 220/571, 573.1, 576, 577, 581, 582, 585, 220/586, 592.01, 592.02, 592.16, 592.17, 220/592.25, 592.26, 592.27, 600, 619, 220/62.11, 620, 621, 624, 629, 634, 640, 220/659, 660, 661, 666, 671, 673, 676, 220/678, 680, 691, 694, 721, 728, 735, 220/745, 746, 754, 782, 789, 799, 8, 801, 220/810, 849, 86.1, 86.2, 86.3, 88.2, 89.1, 220/89.2, 9.4, 901, 902, 917, DIG. 14, 220/DIG. 19, DIG. 23, DIG. 32, DIG. 7, 220/1.6, 2.1 A, 2.1 R, 2.2, 2.3 A, 2.3 R, 220/203.08, 216, 23.6, 23.89, 23.91, 220/259.1, 260, 266, 270, 380, 4.21, 220/495.02, 495.03, 495.05, 495.06, 507, 220/592.2, 62.15, 628, 669, 705, 724, 220/737, 847, 7; 239/1, 102.2, 11, 12, 239/124, 128, 135, 137, 142, 152, 154, 239/155, 16, 17, 211, 215, 221, 222, 306, 239/323, 329, 333, 338, 344, 346, 349, 239/390, 398, 4, 418, 433, 434, 525, 526, 239/569, 577, 586, 6, 61, 63, 67, 69, 71, 239/8, 87, 9

See application file for complete search history.

(56) References Cited

U.S. PATENT DOCUMENTS

| | | | | |
|---|---|---|---|---|
| 4,949,858 | A | 8/1990 | Sheridan | |
| 5,224,674 | A * | 7/1993 | Simons | A61M 5/1418 604/80 |
| 5,437,382 | A | 8/1995 | Gluckman | |
| 5,803,310 | A * | 9/1998 | Soon | B65D 47/06 222/1 |
| 5,904,259 | A | 5/1999 | Hidding et al. | |
| 6,966,581 | B2 * | 11/2005 | Mastropaolo | F16L 35/00 285/422 |
| 8,859,289 | B2 | 10/2014 | Marty et al. | |
| 10,953,346 | B2 | 3/2021 | Song et al. | |
| 11,042,788 | B2 | 6/2021 | Kluckner et al. | |
| 11,357,313 | B2 | 6/2022 | Radcliffe et al. | |
| 2009/0212001 | A1 | 8/2009 | Clemente | |
| 2012/0223044 | A1 | 9/2012 | Scott, III et al. | |
| 2013/0123725 | A1 * | 5/2013 | Schwarz | B65D 47/2043 604/327 |
| 2021/0269206 | A1 | 9/2021 | Knight et al. | |
| 2021/0274916 | A1 | 9/2021 | Radcliffe et al. | |
| 2022/0304455 | A1 * | 9/2022 | Radcliffe | B65D 47/06 |

FOREIGN PATENT DOCUMENTS

| | | | | |
|---|---|---|---|---|
| JP | 2000247353 | A * | 9/2000 | B65D 77/28 |
| WO | 2022074414 | A1 | 4/2022 | |

OTHER PUBLICATIONS

"Canary Safe(TM) Solvent Safety Products: Mobile Phase Bottle Safety Caps" 2022, https://www.analytical-sales.com/product-category/canary-safe-solvent-safety-products/mobile-phase-bottle-safety-caps/.

International Search Report and Written Opinion in PCT/US2024/021036 mailed on Jun. 17, 2024.

* cited by examiner

SOLVENT TUBE MANAGEMENT

RELATED APPLICATION

This application is a non-provisional patent application claiming priority to U.S. Provisional Patent Application No. 63/454,538, filed Mar. 24, 2023, titled "Solvent Tube Management," which is incorporated herein by reference.

FIELD OF THE INVENTION

The disclosed technology generally relates to solvent sources for liquid chromatography. More particularly, the technology relates to the identification and organization of solvent bottles and tubing in a liquid chromatography system.

BACKGROUND

Chromatography systems typically include multiple sources of solvents. One or more of the solvents may be combined to form a mobile phase. Other solvents may include one or more wash solvents and/or flush solvents used to clean or flush components of the system. Each solvent may be supplied in a bottle or container. A tube is generally used to conduct the solvent from the bottle to a corresponding port in the chromatography system. For example, a tube may be inserted through a bottle cap such that an inlet end of the tube extends to near or at the bottom of the bottle and the outlet end of the tube is coupled to a corresponding system inlet port. In one example in which multiple solvent bottles are used, the outlet end of a tube extending from each bottle is coupled to a corresponding inlet port of a gradient proportioning valve and the outlet port of the gradient proportioning valve provides a solvent flow composed of the contributions of the solvents supplied at the inlet ports to a pump inlet. In an alternative example, the outlet end of each tube is coupled to its own pump and the resulting high pressure flows from the pumps are combined and mixed. In other implementations, one or solvent bottles may have multiple tubes to conduct the solvent to multiple inlet ports.

Solvent bottle and solvent line management for liquid chromatography systems can be challenging. The tubing may include similar tubes, that is, tubes having the same diameter and color, thereby making tube identification difficult. Additionally, the tubing may be made of a flexible material (e.g., fluorinated ethylene-propylene (FEP)) and the tubes may be in close proximity near the solvent bottles, making the task of identifying a tube used to couple a solvent bottle to a specific port in the chromatography system difficult.

SUMMARY

In one aspect, a bottle cap for identification of tubing coupled to a solvent container includes a lower cap body, an upper cap body and a liner. The lower cap body has an axial opening and a cylindrical wall with threads thereon to engage a threaded portion of a solvent container about an opening in the solvent container. The lower cap body is securable to the solvent container. The upper cap body is attached to the lower cap body and has a cap wall and a base with an opening therein to pass one or more solvent tubes. The upper cap body has at least one attachment feature to secure an identification flag. The liner is disposed in the lower cap body and has one or more openings. Each opening in the liner is configured to pass one of the solvent tubes passed through the opening in the base of the upper cap body.

The upper cap body may be configured to rotate independent of the lower cap body about a cap axis. The lower cap body may be securable to a threaded neck of the solvent container by rotation about the cap axis.

At least one of the lower cap body and the upper cap body may be formed of high density polyethylene.

The bottle cap may further include the identification flag and the identification flag may have an opening to pass one of the one or more solvent tubes. The identification flag may be configured to maintain a position of a portion of the solvent tube passed through the opening in the identification flag with respect to the solvent container. The identification flag may be a tab configured to extend from the upper cap body. The identification flag may include at least one alphanumeric symbol and may be color-coded and/or shape-coded. The identification flag may include an attachment clip and wherein the attachment feature includes a rim to receive the attachment clip.

The attachment feature may include a slot in the cap wall that extends from an upper rim of the upper cap body. The upper cap body may include a pair of tabs adjacent to an upper end of the slot with each tab extending radially inward from the cap wall at the upper rim and being adjacent to a side of the slot that is opposite to the other tab.

BRIEF DESCRIPTION OF THE DRAWINGS

The above and further advantages of this invention may be better understood by referring to the following description in conjunction with the accompanying drawings, in which like numerals indicate like structural elements and features in the various figures. For clarity, not every element may be labeled in every figure. The drawings are not necessarily to scale, emphasis instead being placed upon illustrating the principles of the invention.

DETAILED DESCRIPTION

Figure 1:
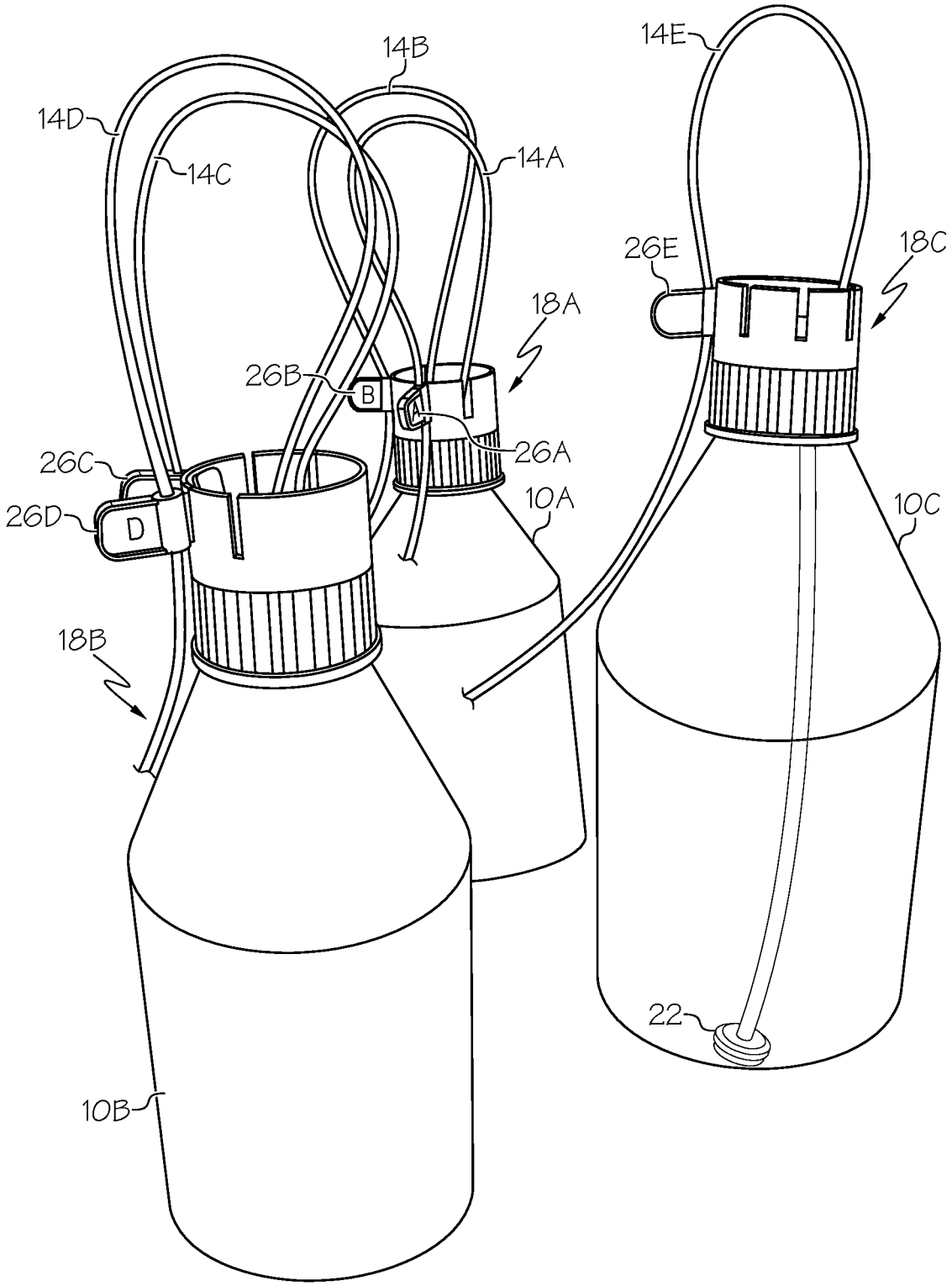
FIG. 1 is an illustration of solvent bottles having one or more solvent tubes having bottle caps with identification flags used to identify and organize the tubes.

Reference in the specification to an embodiment or example means that a particular feature, structure or characteristic described in connection with the embodiment or example is included in at least one embodiment or example of the teaching. References to a particular embodiment or example within the specification do not necessarily all refer to the same embodiment or example.

The present teaching will now be described in detail with reference to exemplary embodiments or examples thereof as shown in the accompanying drawings. While the present teaching is described in conjunction with various embodiments and examples, it is not intended that the present teaching be limited to such embodiments and examples. On the contrary, the present teaching encompasses various alternatives, modifications, and equivalents, as will be appreciated by those of skill in the art. Moreover, features illustrated or described for one embodiment or example may be combined with features for one or more other embodiments or examples. Those of ordinary skill having access to the teaching herein will recognize additional implementations, modifications, and embodiments, as well as other fields of use, which are within the scope of the present disclosure as described herein.

In brief overview, embodiments and examples disclosed herein are directed to a bottle cap for identification of tubing coupled to a solvent container. The bottle cap includes a lower cap body that is threaded for attachment about an opening in a solvent container and an upper cap body attached to the lower cap body. The upper and lower cap bodies may be independently rotated about a cap axis. A liner is disposed inside the lower cap body and includes one or more openings to pass a solvent tube while limiting the evaporation of the solvent to the external environment. Advantageously, the independent rotation capability of the upper and lower cap bodies allows the bottle cap to be removed from or attached to a solvent bottle without the need to remove any solvent tubes passing through the bottle cap. Attachment features in the upper cap body allow for identification flags to be attached. Each identification flag has an opening and can include one or more characters or symbols, color-coding and/or shape-coding to identify the solvent and/or a system inlet to which a corresponding solvent tube is connected at its other end.

As used herein, a bottle cap means a device for closing or sealing a bottle or other container used for holding liquids. Although reference is made primarily to a bottle cap in the following examples, it will be understood that the bottle cap is generally capable of scaling any form of container having an opening to receive or dispense a liquid.

A number of different types of solvents may be used in a chromatography system. For example, systems may require one, two, or more mobile phase solvents, strong and weak wash solutions, seal wash solvent and/or cleaning and rinse solutions and may require additional liquids for maintenance purposes. Within each category of solvent (e.g., mobile phase, wash solution, maintenance fluid) there may be a potentially unlimited number of solutions used for each purpose and the same solutions may potentially be used for more than one purpose in the system. Each of the solvents in the chromatography system may be a single liquid solvent, a mixture of liquids, or a solution with a dissolved solute. The solvents may be used as supplied, or the user may prepare the solvent. Additionally, in applications where a system is designed to switch between different operating modes without user intervention, the system may be provided with several complete sets of mobile phase and wash solutions. For example, in order to be able to run two different gradient elutions, the system may have four mobile phase solvents. The solvent may be of any type, including aqueous and organic solvents, polar and nonpolar solvents, e.g., methanol, ethanol, acetonitrile, tetrahydrofuran, dimethoxyethane, chlorobutane, dichlorobenzene, pentanone, acetone, chloroform, cyclohexane, diethyl ether, ethyl acetate, pentane, hexane, heptane, toluene, water, and combinations of the same.

A solvent including more than one liquid component may be provided in a single container, or the liquid components may be provided by separate containers and mixed by the system. The system may receive two or more solvents which are mixed by the system, for example, to form a mobile phase for an isocratic elution, or to serve as one component of a gradient elution.

The bottle caps described herein may be used with solvents employed with a number of chromatography systems, such as liquid chromatography (LC), high performance liquid chromatography (HPLC), highly compressible fluid chromatography (sometimes referred to as supercritical fluid chromatography (SFC), or $CO_2$-based chromatography where $CO_2$ is used in the mobile phase).

Users of chromatography systems are challenged by tubing management at the location of solvent bottles used to supply solvents to the systems. For example, the identification of tubes coupled to the bottles is often unclear. The tubes look the same and the individual tubes are sometimes gathered into tube bundles. The remote ends of the tubes are coupled to solvent inlets in different modules of the chromatography system that may not be readily observable to the user. Often, a user is faced with the difficult and time-consuming task of tracing one or more tubes from its system inlet port and corresponding solvent bottle to confirm the proper supply of solvents. Prior attempts to simplify this task include using colored tube identifiers which are secured somewhere along the length of each tube. For example, small lengths of colored identifiers in the form of heat shrink tubes can be placed over the solvent tubes and subsequently heat is applied to secure each identifier to its tube. One problem with this organizational technique is that the colored identifiers are not necessarily applied to all the tubes at similar locations along the lengths of the tubes. If a colored identifier is not positioned correctly along the length, it may still be necessary to manually trace a tube to its end to confirm that the tube is in the proper solvent bottle. Another prior organizational technique includes attaching small clip-on flags to the tubes; however, these flags often fall off and are sometimes not reinstalled.

Bottle caps according to the examples described herein provide a number of advantages. For example, an identification flag attached to the bottle cap and passing a tube lets the user know where the remote end of the tube is connected in the chromatography system. Another advantage is the organization of the tubing at the solvent bottles. As each tube exits its solvent bottle through the bottle cap, the corresponding identification flag holds the tube in place with respect to the bottle, thereby reducing slack and tubing disorder in the area around the solvent bottles. The opening in a flag may have a diameter that is greater than the outer diameter of a tube to pass the tube and allow the tube to slide a short distance through the opening for convenient arrangement.

FIG. 1 is an illustration of a collection of three solvent bottles 10A to 10C each having one or more solvent tubes 14A to 14E that pass through a corresponding bottle cap 18A to 18C. A proximate end of each tube 14 is positioned near the bottom of its solvent bottle 10 to ensure that most of the contained solvent can be withdrawn from the bottle 10. A sinker or weight 22 may be attached near or at the proximate end so that the end is maintained at the bottom of the bottle 10. The sinker 22 may include or be a filter that filters solvent drawn into the tube 14.

At least one identification flags 26A to 26E is attached to each bottle cap 18. Each flag 26 is removably attachable to its bottle cap 18 and includes an opening to pass a solvent tube 14 into the bottle cap 18 toward a liner 32 (not visible in FIG. 1, see FIG. 4B). The liner 32 is an internal element of the bottle cap 18 that substantially limits the exposure of the contents of a bottle 10 to the ambient environment. A portion of each tube 14 nearest its proximate end is held in position with respect to the solvent bottle 10 by its flag 26 to thereby reduce clutter that may result from loose tubing.

Each identification flag 26 includes an identification symbol such as an "A", "B", "C" or other alphanumeric character or symbol which identifies the solvent conducted through the corresponding tube. The character or symbol may be on one side or both sides of the flag 26. Alternatively or additionally, the flag 26 may be color-coded such that the color identifies the solvent connection in the chromatography system. Similarly, the flags 26 may be shape-coded such that the shape of the flag is indicative of the solvent connection.

The liner in each bottle cap 18 has multiple openings each configured to pass a single solvent tube. By way of a non-limiting example, there may be five openings to accommodate five tubes in the solvent bottle. In other embodiments, the number of openings can be different. In some embodiments, the number of openings may be different from the number of identification flags that can be attached.

Figure 2:
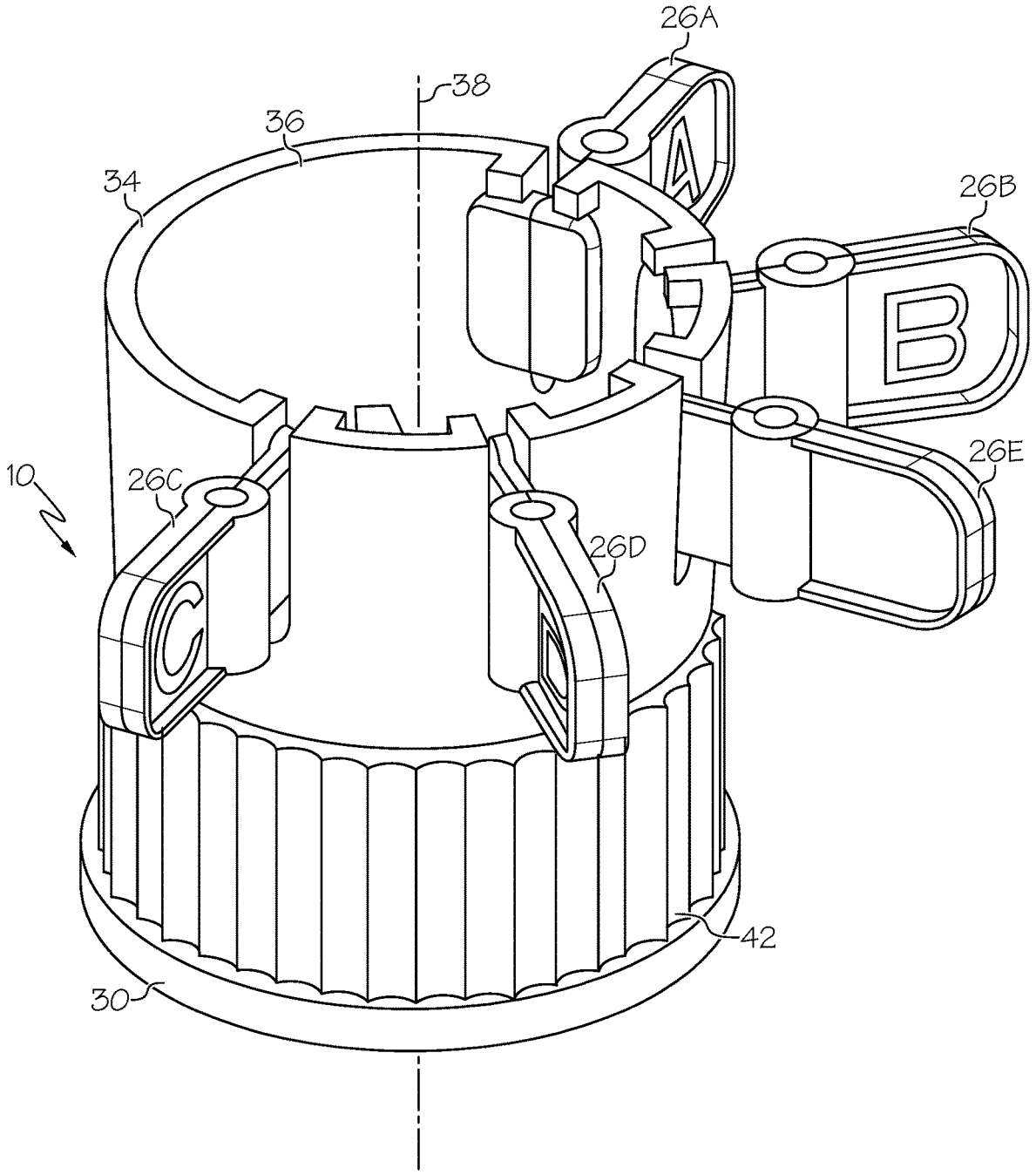
FIG. 2 shows a bottle cap having multiple identification flags according to one embodiment.

Referring to FIG. 2, each bottle cap 10 includes a lower cap body 30 and an upper cap body 34. By way of example, the lower and upper cap bodies 30 and 34 may be made of high density polyethylene (HDPE). The lower cap body 30 has a cylindrical wall and an axial opening at its top. Threads on the inner surface (not visible) of the cylindrical wall enable the bottle cap 10 to engage threads disposed about the opening of a solvent container. Rotation of the lower cap body 30 about a cap axis 38 enables it to be secured to the solvent container.

The upper cap body 34 includes attachment features each adapted to receive an identification flag. In the illustrated example, each attachment features includes, in part, a vertical slot that extends downward from the upper rim 36. In the figure, each of the five slots is occupied by an identification flag 26 although in use the number of flags 26 attached to the bottle cap 10 may be fewer. Preferably, the number of flags 26 is the same as the number of tubes used with the solvent container so that each tube is identified.

The two cap bodies 30 and 34 and the liner can be manufactured as individual pieces and then attached to each other to form the bottle cap 10. For example, the two cap bodies 30 and 34 can be snapped together and the liner may be threaded or otherwise inserted into position inside the lower cap body 30. The lower and upper cap bodies 30 and 34 of the bottle cap 10 are independently rotatable about the cap axis 38. The outer surface of the lower cap body 30 includes vertical ridges 42 to enable it to be grasped and twisted for attachment to and removal from a solvent bottle. In alternative embodiments, the ridges 42 may be absent or the outer surface may be textured or include one or more features to assist a user in grasping and twisting the lower cap body 30. During attachment or removal, the upper cap body 34 may be held substantially stationary. Advantageously, when removing the bottle cap to enable the solvent in a bottle to be replenished, there is no need to disconnect the tubes. Consequently, refilling of solvents occurs faster and the risk of misrouting tubes is minimized.

Figure 3:
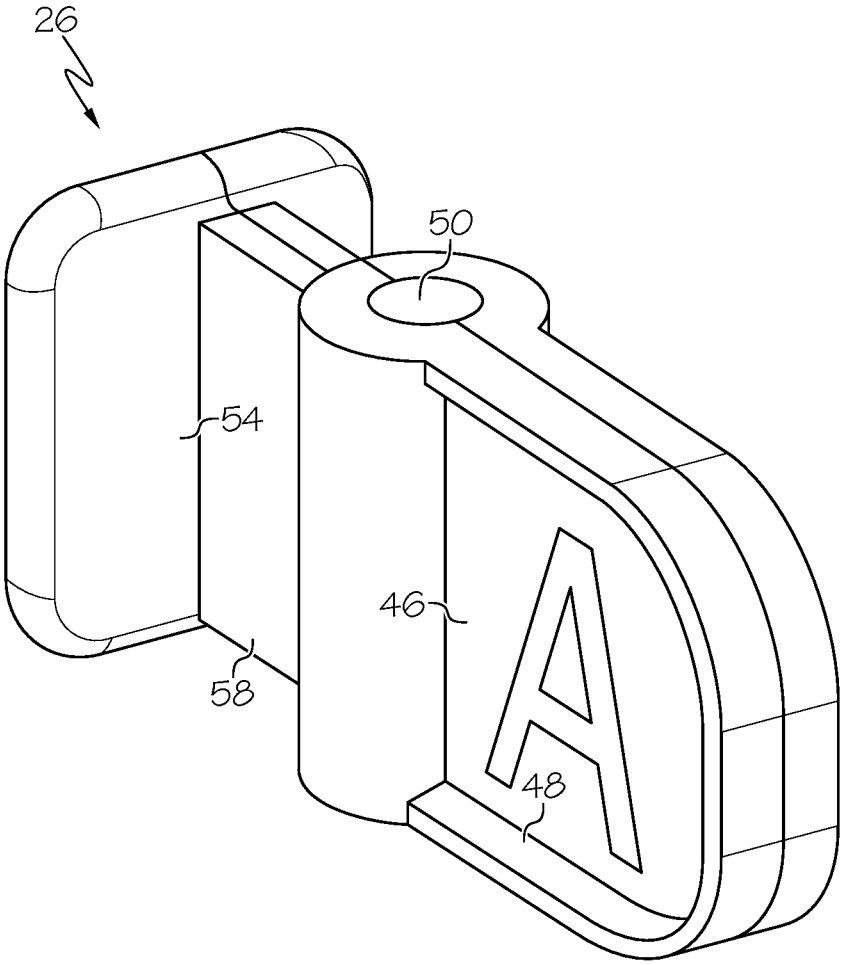
FIG. 3 shows an identification flag according to one embodiment.

FIG. 3 shows a detailed view of an identification flag 26 in the form of a tab that extends from the upper cap body when attached to the bottle cap. The identification character "A" is on a flat surface 46 that is recessed from a tab edge 48. A user can grasp the flat surface 46 and the opposing flat surface between thumb and finger when a solvent tube is passed through the opening 50 during system setup and when the flag 26 is attached to or removed from the upper cap body during setup, bottle replacement or solvent replenishment. The flag 26 includes a flange 54 at one end and a narrow flat region 58 between the flange 54 and opening 50.

Figure 4A:
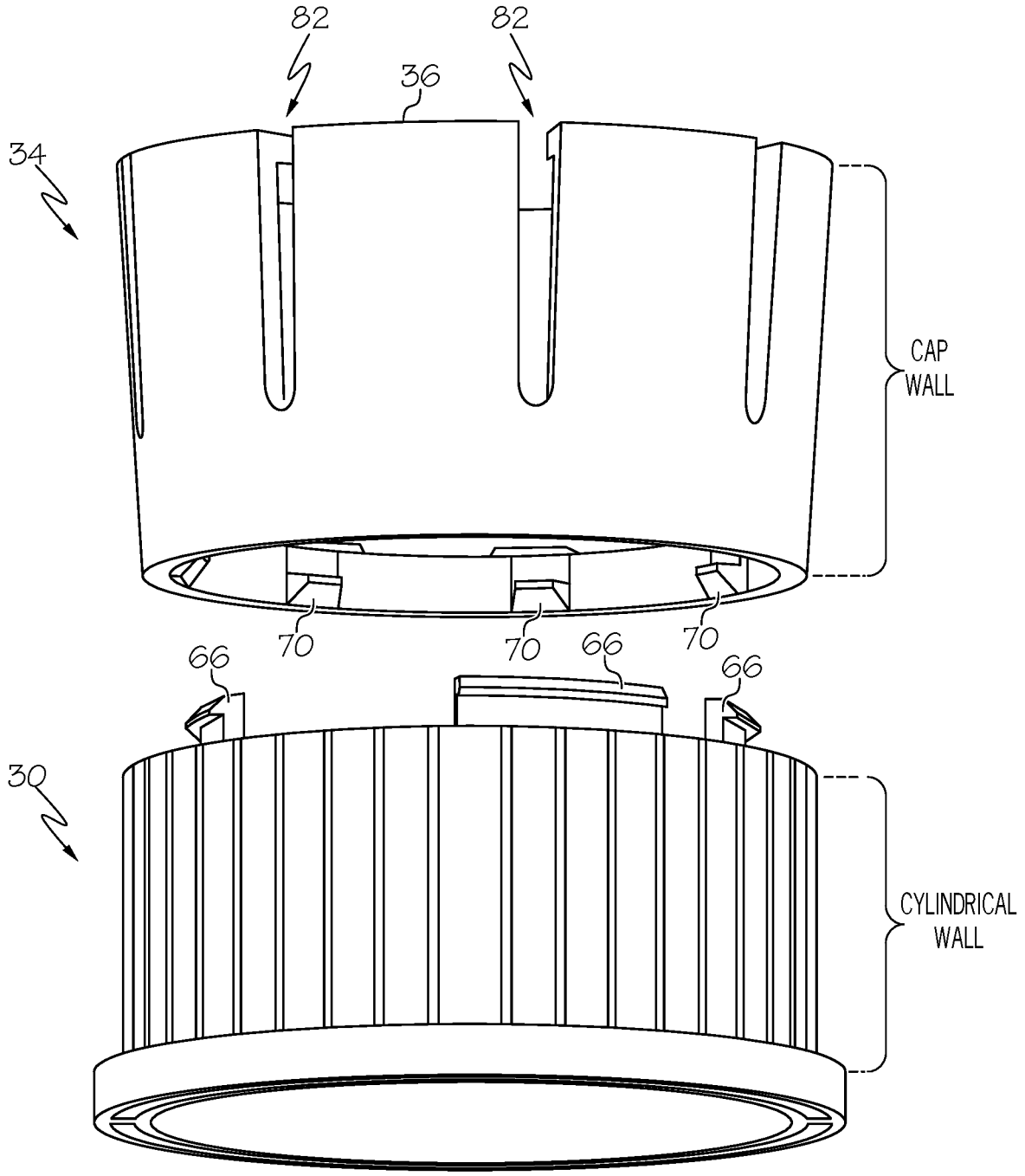
FIG. 4A shows a disassembled view of the bottle cap of FIG. 2.
Figure 4B:
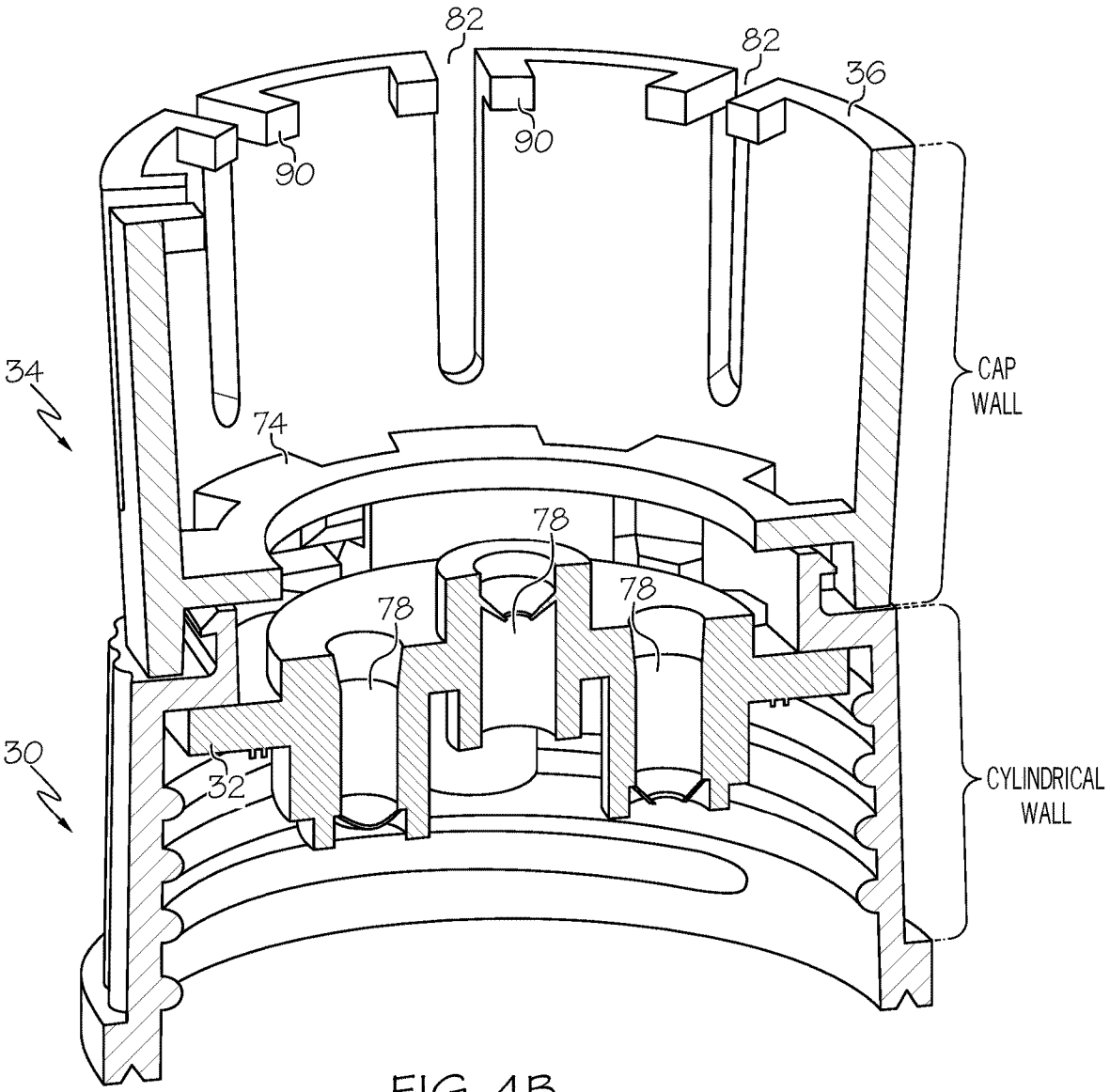
FIG. 4B shows a cutaway view of the bottle cap of FIG. 2 with the lower cap body, upper cap body and liner assembled together.

FIG. 4A shows a disassembled view of the bottle cap and FIG. 4B shows a cutaway view of the same bottle cap with the lower and upper cap bodies 30 and 34 and the liner 32 assembled together. The lower cap body 30 includes a cylindrical wall with threads 62 on the inner surface of the wall to engage a threaded neck of a solvent container. The inner diameter of the cylindrical wall is selected match the diameter of the neck. Thus, bottle caps of different diameters may be employed with solvent bottles having different neck diameters.

Tabs 66 extend upward to engage complementary tabs 70 or opposing surfaces along the bottom circumference of the upper cap body 34. In a variation of this engagement structure, the tabs 66 and 70 can be structured to achieve a tongue and groove attachment. When the lower cap body 30 is rotated with respect to the upper cap body 34, the tabs 66 move with respect to the complementary tabs/surfaces 70 while preventing the vertical separation of the two pieces.

In other embodiments, the means for engaging the lower and upper cap bodies 30 and 34 may be different. For example, the diameter of the upper cap body 34 may be less than the diameter of the lower cap body 30 and instead of complementary tabs 70 extending radially inward, tabs may extend radially outward to engage corresponding features on the lower cap body 30. In another alternative embodiment, the tabs 66 and 70 may each be replaced by a single structure that extends continuously around the circumference of the corresponding cap body 30 or 34 where the structure is sufficiently flexible so that the two bodies may be snapped together to form the bottle cap.

Referring again to FIGS. 4A and 4B, the upper cap body 34 includes a base ("floor") 74 and a cap wall. The liner 32 is disposed in the lower cap body 30 and includes openings 78 to pass the tubes extending into the solvent bottle. The liner 32 limits the evaporation that can occur to the external environment. The slots 82 that receive the identification flags extend downward from the upper rim 36 through the cap wall. Preferably, the number of openings 78 is equal to or greater than the number of slots 82.

Figure 5A:
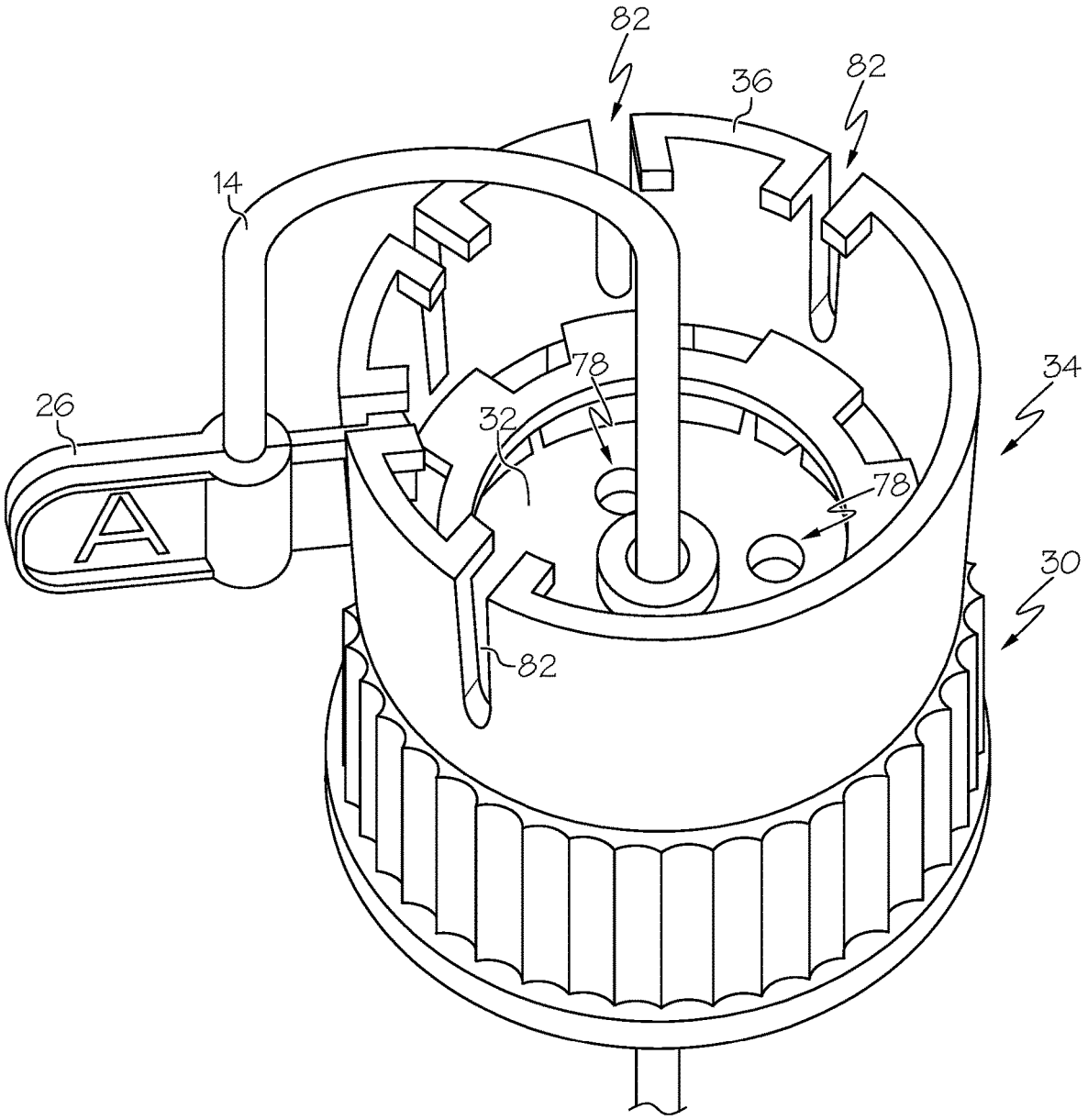
FIG. 5A shows a perspective view of a bottle cap configured with a single solvent tube and identification flag.
Figure 5B:
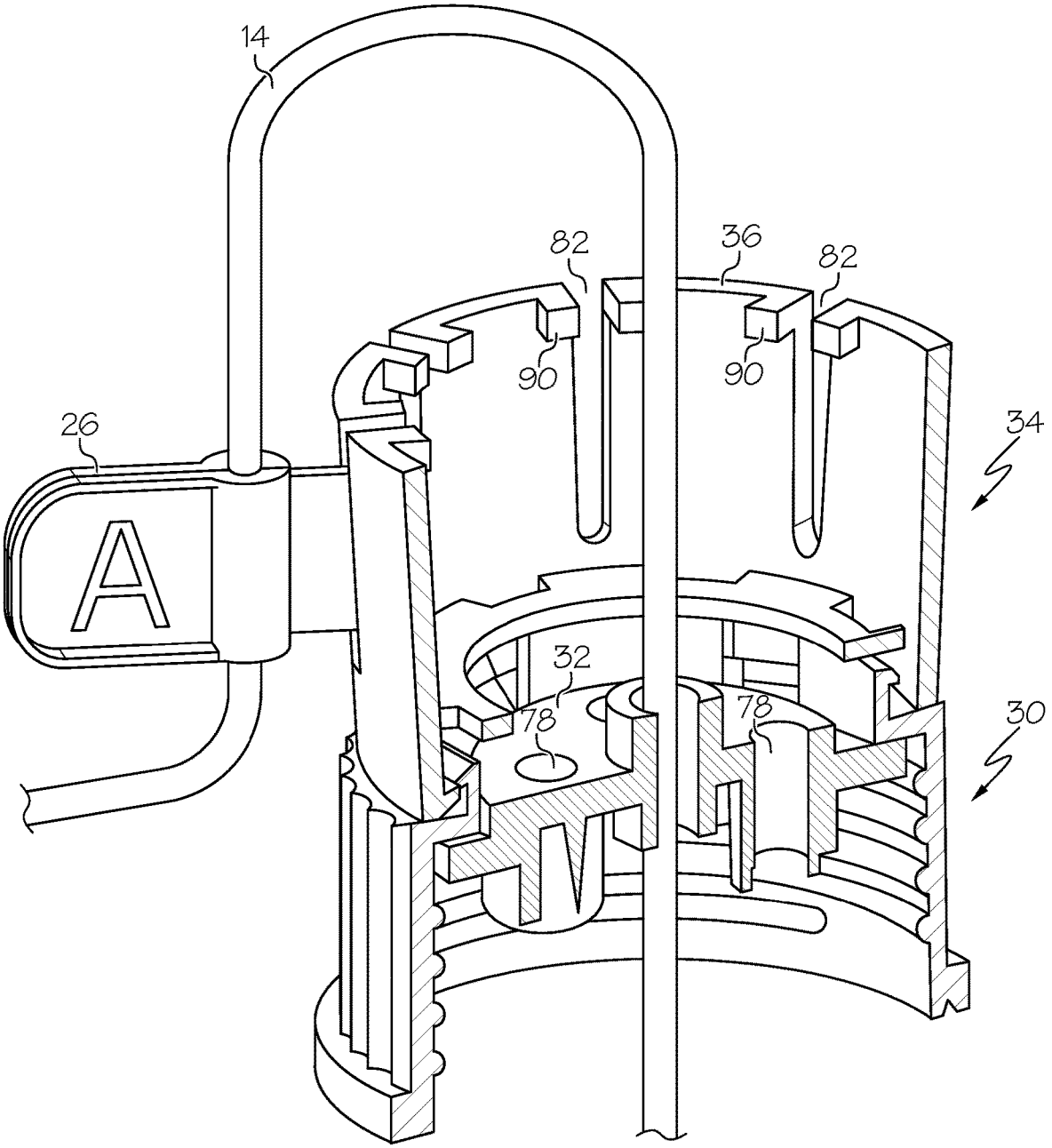
FIG. 5B shows a cutaway side view of the bottle cap of FIG. 5A.

Along with a slot 82, each attachment feature includes a pair of tabs 90 located adjacent to an upper end of the slot 82 to hold the identification flag in place. Each tab 90 extends radially inward from the cap wall at the upper rim 36 and is adjacent to a side of the slot 82 that is opposite to the other tab 90. Each pair of tabs 90 captures the flange portion of the flag inserted in the slot 82. For example, FIGS. 5A and 5B show a perspective view and a cutaway side view, respectively, of a bottle cap configured with a single solvent tube 14 and a corresponding identification flag 26. The wall of the upper cap body 34 can be made of a flexible material to improve the case with which a flag 26 is attached or removed.

In other embodiments of a bottle cap, the attachment features in the upper cap body used to receive an identification flag may be different. In one example, the tabs that retain the flags in their slots may extend radially outward from the outer diameter of the upper cap body. In other examples, slots may not be utilized. Instead, the upper cap body can have openings circumferentially arranged and configured to receive a dowel pin where each flag also has an opening to receive the dowel pin. In still another example, each flag includes a feature, such as an attachment clip, to enable the flag to be attached to a rim (e.g., upper rim 36)

on the upper cap body by an interference fit. Those of skill in the art will recognize other means that may be used to attach the identification flags to the upper cap body.

In the examples described above, the identification flags include a single alphanumeric character or a single symbol; however, two or more characters or symbols can be present on each flag. Similarly, for color-coded flags, more than one color can be used on a flag for identification.

In the illustrated examples described herein, the lower cap body 30 is threaded to enable engagement with a threaded portion on the neck of a solvent bottle. In an alternative embodiment, the lower cap body is at least partially formed of a compliant material that allows it to be inserted into the neck of a solvent bottle and engage the inner surface of the neck. In such an embodiment, the lower cap body can engage the neck of the bottle in much the same way as a cork stopper is used although the lower cap body is hollow to pass the solvent tubes. Thus, no threads are necessary and no rotation is required for attachment to or removal from a solvent bottle.

While various examples have been shown and described, the description is intended to be exemplary, rather than limiting and it should be understood by those of ordinary skill in the art that various changes in form and detail may be made therein without departing from the scope of the invention as recited in the accompanying claims. For example, embodiments of bottle caps described above are discussed in connection with solvents for a chromatography system; however, it will be recognized that the bottle caps can be used with a variety of other systems in which multiple liquids stored in independent containers are routed to various system ports.

What is claimed is:

1. A bottle cap for identification of tubing coupled to a solvent container, comprising:

a lower cap body having an axial opening and a cylindrical wall with threads thereon to engage a threaded portion of a solvent container about an opening in the solvent container, wherein the lower cap body is securable to the solvent container;

an upper cap body attached to the lower cap body and having a cap wall and a base with an opening therein to pass one or more solvent tubes, the upper cap body having at least one attachment feature to secure an identification flag; and at least one identification flag having an identifier to indicate a solvent conducted through one of the one or more solvent tubes and being removably attachable to the upper cap body at one of the at least one attachment features and having an opening to pass the one of the one or more solvent tubes; and a liner disposed in the lower cap body and having one or more openings, wherein each opening in the liner is configured to pass one of the solvent tubes passed through the opening in the base of the upper cap body.

2. The bottle cap of claim 1 wherein the upper cap body is configured to rotate independent of the lower cap body about a cap axis.

3. The bottle cap of claim 2 wherein the lower cap body is securable to a threaded neck of the solvent container by rotation about the cap axis.

4. The bottle cap of claim 1 wherein at least one of the lower cap body and the upper cap body is formed of high density polyethylene.

5. The bottle cap of claim 1 wherein the identification flag is configured to maintain a position of a portion of the solvent tube passed through the opening in the identification flag with respect to the solvent container.

6. The bottle cap of claim 5 wherein the identification flag is a tab configured to extend from the upper cap body.

7. The bottle cap of claim 1 wherein the identification flag includes at least one alphanumeric symbol.

8. The bottle cap of claim 1 wherein the identification flag is color-coded.

9. The bottle cap of claim 1 wherein the identification flag is shape-coded.

10. The bottle cap of claim 1 wherein the attachment feature includes a slot in the cap wall that extends from an upper rim of the upper cap body.

11. The bottle cap of claim 10 wherein the upper cap body includes a pair of tabs adjacent to an upper end of the slot, each tab extending radially inward from the cap wall at the upper rim and being adjacent to a side of the slot that is opposite to the other tab.

12. The bottle cap of claim 1 wherein the identification flag includes an attachment clip and wherein the attachment feature includes a rim to receive the attachment clip.

* * * * *